United States Patent [19]

Coates

[11] Patent Number: 4,901,492

[45] Date of Patent: Feb. 20, 1990

[54] CAP FOR SWIMMING POOL COPING

[75] Inventor: Paul A. Coates, Burford, Canada

[73] Assignee: Pleasure-Way Pools (1978) Limited, Brantford, Canada

[21] Appl. No.: 309,853

[22] Filed: Feb. 14, 1989

[51] Int. Cl.[4] ..... E04H 12/00; F21V 8/00

[52] U.S. Cl. ..... 52/300; 362/32; 362/101; 4/506

[58] Field of Search ..... 362/101, 32, 267, 253; 52/300; 4/506

[56] References Cited

U.S. PATENT DOCUMENTS

| | | | |
|---|---|---|---|
| 1,762,383 | 6/1930 | Booraem | 362/101 |
| 3,511,002 | 5/1970 | Fox | 52/300 |
| 3,512,326 | 5/1970 | Greene | 52/300 |
| 4,004,386 | 1/1977 | Diffenderfer | 52/300 |
| 4,203,170 | 5/1980 | Lankheet | 4/506 |
| 4,457,119 | 7/1984 | Dahowski | 4/506 |
| 4,625,266 | 11/1986 | Winter | 362/32 |
| 4,782,430 | 11/1988 | Robbins et al. | 362/267 |

*Primary Examiner*—Ira S. Lazarus
*Assistant Examiner*—D. M. Cox
*Attorney, Agent, or Firm*—Berman, Aisenberg & Platt

[57] ABSTRACT

The present invention relates to an improved cap for swimming pool coping of the type incorporating a bead retainer for a circumscribing bead of a pool cover. The cap comprises a longitudinally extending body having securing means to releasably secure the cap to the coping. A groove longitudinally extends in the front of the cap for releasably securing the pool cover bead and means on the entrance to the groove for releasably retaining therein a plug strip whereby water and debris are blocked from entering the groove. The groove may alternatively releasably receive the bead of the pool cover, or hold therein a plug a strip means or a strip light means, the latter preferably made of fibre optic cable to light the periphery of the pool for safety at night.

15 Claims, 1 Drawing Sheet

CAP FOR SWIMMING POOL COPING

The present invention relates to a cap for a swimming pool coping, and more particularly to such a cap which serves a variety of functions including lighting the periphery of the pool.

FIELD OF THE INVENTION

Swimming pool coping is used to cap the upper edge of a swimming pool. Conventionally swimming pool copings may be made of extruded metal such as aluminum or plastic. They are positioned usually at the juncture of the vertical swimming pool walls and the horizontal deck which circumscribes the swimming pool, and form the transition piece therebetween. Copings may be used to retain in place the upper peripheral bead of a swimming pool vinyl liner.

BACKGROUND OF THE INVENTION

Conventional swimming pool copings have many different constructions. For example, Canadian Pat. No. 1,179,454 of Dahowski issued Dec. 18, 1984 describes and illustrates a coping for vertical positioning along the upper edge of the side of a swimming pool, the coping having longitudinally extending grooves therein for releasably holding for example the bead of the pool liner, the bead of a dome to cover the pool, etcetera.

Such copings have also been developed having therein a groove or track for releasably securing the peripheral bead of a pool cover.

Lighting of a swimming pool for safety and appearance at night time has been conventionally carried out by means of lights mounted and sealed in the vertical walls of the pool, or by exterior lights mounted about the pool.

It is an object of the present invention to provide a more versatile construction of coping which coping may in one form releasably hold therein means to light the periphery of the pool at night time.

SUMMARY OF THE INVENTION

In accordance with the present invention there is provided a cap for a swimming pool coping which cap incorporates a bead retainer for a circumscribing bead of a pool cover. The cap comprises a longitudinally extending body having securing means to releasably secure the cap to the coping. A groove longitudinally extends in the front of the cap within which to releasably secure the pool cover bead. Means on the entrance to the groove releasably retain a plug strip within that entrance so that water and debris are blocked from entering the groove.

It is preferred that the cap be further provided with an elongated plug strip means for the groove, for releasably inserting in the cap groove at its entrance. The plug strip means has longitudinal edges along which are provided means for cooperating with the means on the groove entrance for releasably securing the plug strip means therein.

Additional to or incorporated in the plug strip means, elongated strip light means may be provided for illuminating the periphery of the pool, the elongated strip light means to be releasably inserted into the cap groove at its entrance. The strip light means is preferably a fibre optic cable means.

Alternatively, the cap may be formed integral with the coping.

The cap and coping in accordance with the present invention provide a more versatile coping construction which may be used not only to hold a vinyl liner for the pool, but additionally to releasably secure in position the bead of a pool cover or strip light means for illuminating the periphery of the pool. The lighting provides a visual illumination of the edge of the pool without providing an obstruction about the pool periphery over which someone might readily trip. In other words, in accordance with the present invention, the coping and cap may be virtually flush mounted about the periphery of top of the pool wall. When not in use, for example in wintertime, the strip lighting may be removed and replaced with a plug strip means to keep the groove dry and clean.

BRIEF DESCRIPTION OF THE DRAWINGS

These and other objects and advantages of the invention will become apparent upon reading the following detailed description and upon referring to the drawings in which.

Figure 1:
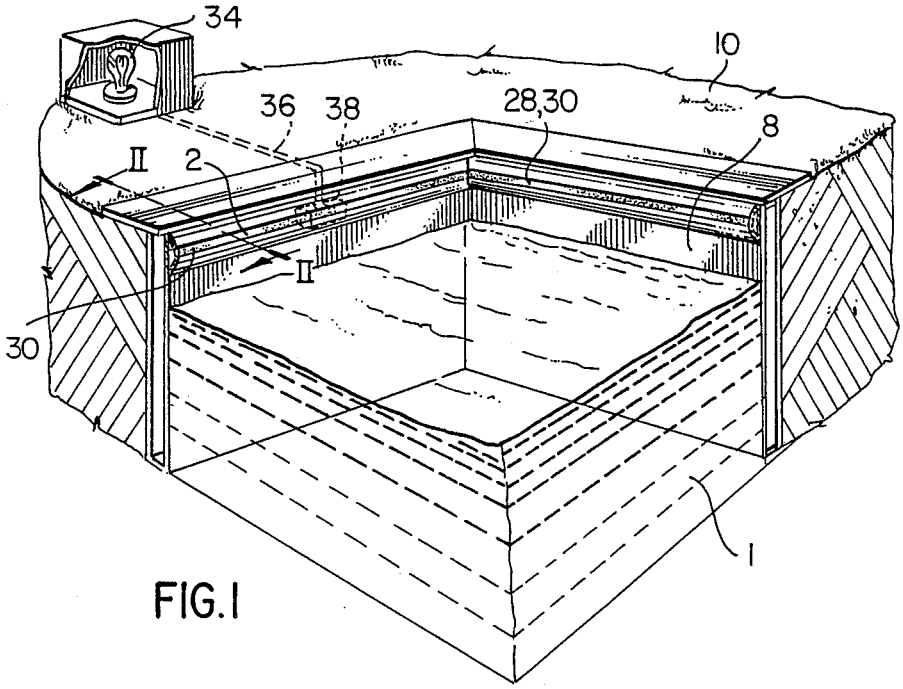
FIG. 1 is a peripheral view of a swimming pool with a peripheral cap and coping in accordance with the present invention.

While the invention will be described in conjunction with example embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
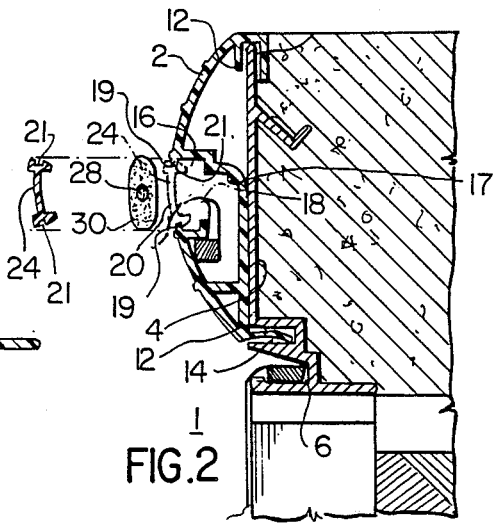
FIG. 2 is a transverse sectional view of the cap and coping of FIG. 1 along line II—II.

Turning to FIGS. 1 and 2 there is illustrated about a swimming pool 1, a cap 2 made of appropriate plastic such as PVC, of bull nose or convex exterior shape, releasably secured to a coping 4 about the periphery of swimming pool 1. Coping 4 is, for example, made of extruded aluminum. As can be seen in the cross-section view of FIG. 2, coping 4 has an elongated slot 6 extending along its length for releasably securing therein the bead of a conventional vinyl liner for the pool Coping 4 is generally vertically positioned about the top of pool walls 8, and forms a junction between those pool walls 8 and deck 10 about the periphery of the pool. Cap 2 is provided with means 12, at either side, for releasable attachment in cooperating attachment means 14 spaced to the sides of coping 4.

Figure 3:
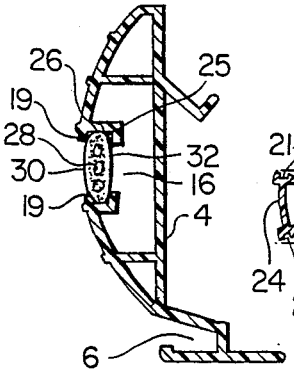
FIG. 3 is a similar transverse sectional view of an alternative embodiment of cap and coping in accordance with the present invention.

Alternatively, as illustrated in FIG. 3, cap 2 and coping 4 may be formed of integral construction, for example by means of an appropriate extrusion from a single die. In this case, of course, attachment means 12 and 14 of FIGS. 1 and 2 are not required.

Cap 2 has an outer surface, as illustrated, of convex or bull nose shape in the transverse direction.

In cap 2, longitudinally extending along its length, and somewhat centrally positioned therein, is a groove 16, the interior 17 of which is conformed to enable it to releasably receive the circumscribing bead 18 of a pool cover. Facing protrusions 19 are provided at entrance 20 to groove 16, these protrusions preferably extending the length of groove 16, to be releasably insertable in snap-in fashion, into grooves 21 in the opposite sides 22 of a plug 24. When in position at the entrance to groove 16, the outer surface of plug 24 forms an extension of and is flushed with the upper surfaces of cap 2 on either side of groove 16. Plug 24 acts as a seal to prevent water or other debris from entering groove 16 when that groove is not in use. This plug may be simply a plastic plug of appropriate construction.

In a preferred embodiment of the present invention, the entrance to groove 16 is further provided with oppositely spaced, longitudinally extending grooves or tracks 25, protrusions 19 forming one side of each of the grooves or tracks as illustrated. Into these grooves or tracks are releasably inserted opposite sides 26 of a light or fibre optic strip means 28. Fibre optic strip means 28 may for example comprise an elongated body 30 of transparent plastic within which is seated a fibre optic cable 32 extending along its length. So that light is transmitted from the fibre optic cable along its length, and not merely at its end, the cable is appropriately provided with "faults" in a manner known in the art. The fibre optic cable, when lit, lights the edge of the perimeter of the pool for safety at night and also for an attractive appearance. The fibre optic cable may of course be made from a plurality of optic strands within transparent plastic body 30.

Light to illuminate cable 32 may for example come from a remote light source 34 (FIG. 1) and be transmitted from that source through a fibre optic cable 36 to pool circumscribing fibre optic cable 32. An appropriate connection means 38 between cable 36 and 32 is provided to permit, when the cables are connected, the delivery of light from light source 34 to cable 32. This permits fibre optic cable 32 to be disconnected from fibre optic cable 36 and transparent plastic body 30 with cable 32 within to be removed from groove 16 for example when the pool is not in use for long periods of time, such as over winter. Then either the bead of the pool cover is inserted into groove 16, or plug 24 snapped into place on protrusions 19 until it is desired to reinsert light strip means 28.

Thus it is apparent that there has been provided in accordance with the present invention a cap for swimming pool coping that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a cap for swimming pool coping about the periphery of a swimming pool, the cap incorporating a bead retainer for a circumscribing bead of a pool cover, the improvement characterized by the cap comprising a longitudinally extending body having securing means to releasably secure the cap to the coping, a groove longitudinally extending in the front of the cap within which to releasably secure the pool cover bead and means on the entrance to the groove for releasably retaining therein a plug strip means within that entrance so that water and debris are blocked from entering the groove.

2. A cap according to claim further comprising an elongated plug strip means for the groove for releasably inserting in the cap groove at its entrance, the plug strip means having longitudinal edges along which are provided means for cooperating with the means on the groove entrance for releasably securing the plug strip means therein.

3. A cap according to claim 1 further comprising elongated light strip means for illuminating the periphery of the pool, the elongated light strip means to be releasably inserted into the cap groove at its entrance, the light strip means having longitudinal edges along which are provided means for cooperating with means on the groove entrance for releasably securing the light strip means therein.

4. A cap according to claim 2 wherein the plug means comprises light strip means for illuminating the periphery of the pool.

5. A cap according to claim 3 wherein the light strip means comprises a fibre optic cable means, the cable means to receive light for lighting the periphery of the pool for safety at night.

6. A cap according to claim 5 wherein the light strip means comprises a transparent retainer body within which the fibre optic cable means is positioned, the retainer body releasably securable in the entrance to the groove of the cap.

7. A cap according to claim 4 in combination with a coping, the coping being provided with means when in position about the periphery of the pool to releasably retain the cap in a generally vertical orientation.

8. A cap according to claim 5 in combination with a light source to be positioned remote from the pool, fibre optic means extending from the light source to the fibre optic cable means of the cap to deliver light thereto.

9. A cap according to claim 8 wherein the fibre optic cable means of the cap and the fibre optic means extending from the light source are provided with releasable connection means permitting, when connected, the delivery of light from the light source to the fibre optic cable means.

10. A cap according to claim 2 further comprising elongated light strip means for illuminating the periphery of the pool, the elongated light strip means to be releasably inserted into the cap at its entrance, the strip light means having longitudinal edges along which are provided means for cooperating with means on the groove entrance for releasably securing the light strip means therein.

11. A cap according to claim 1 having a top surface convexly curved in the transverse direction, the groove being centrally positioned therein.

12. A cap according to claim 1 wherein the means for releasably retaining the plug strip means comprises opposite facing protrusions extending along the entrance to the groove, these protrusions to be releasably seated in cooperating slots on opposite sides of the elongated plug strip means.

13. A cap according to claim 12 wherein the entrance to the groove further comprises facing, longitudinally extending grooves at the entrance to the cap groove, these grooves at the entrance to the cap groove to releasably retain therein opposite sides of an elongated light strip means to be releasably inserted into the cap groove at its entrance.

14. A cap according to claim 3 wherein the entrance to the groove further comprises facing, longitudinally extending grooves at the entrance to the cap groove, these grooves at the entrance to the cap groove to releasably retain therein opposite sides of the elongated light strip means to be releasably inserted into the cap groove at its entrance.

15. A cap according to claim 13 wherein each of said protrusion constitutes a side of one of said grooves at the entrance to the longitudinally extending groove in the cap.

* * * * *